United States Patent [19]

Ivey

[11] 4,067,341

[45] Jan. 10, 1978

[54] PIERCED EARLOBE PROTECTOR

[75] Inventor: Mary C. Ivey, Atlanta, Ga.

[73] Assignees: David S. Bailey; Richard J. Pope; Earrs, Inc., all of Gainesville, Ga.

[21] Appl. No.: 667,020

[22] Filed: Mar. 15, 1976

[51] Int. Cl.[2] ..... A61F 11/00

[52] U.S. Cl. ..... 128/330

[58] Field of Search ..... 128/330 R, 329 R, 305 R, 128/151; 63/13

[56] References Cited

U.S. PATENT DOCUMENTS

| | | | |
|---|---|---|---|
| 113,031 | 3/1871 | Edge | 128/329 R |
| 161,853 | 4/1875 | Baker | 63/13 |
| 2,713,863 | 7/1955 | Handerson | 128/330 |
| 3,608,095 | 9/1971 | Barry | 128/330 |
| 3,766,923 | 10/1973 | Boretos | 128/329 R |

*Primary Examiner*—Robert W. Michell
*Assistant Examiner*—Henry J. Recla
*Attorney, Agent, or Firm*—Clarence A. O'Brien; Harvey B. Jacobson

[57] ABSTRACT

A protector for pierced earlobes has a hollow body forming a through passage for receiving the post or stem of an earring and provided with an outer surface constructed from a non-irritating, hypoallergenic material for protecting the tissue of the lobe from possible irritation, infection and allergic reactions to the metal material forming the post or stem of the earring. The protector, in some embodiments, is a liner which may be first inserted through the hole in the earlobe and, in other embodiments, the protector is mounted frictionally or permanently to the supporting post, stem or other supporting element for the earring.

2 Claims, 6 Drawing Figures

PIERCED EARLOBE PROTECTOR

BACKGROUND OF THE INVENTION

1. Field of the Invention

This invention relates generally to a pierced earlobe protector, and more particularly to a liner positioned between the interior of a passageway formed in the earlobe and a post or stem of an earring for preventing an earring from irritating the tissue of a pierced earlobe.

2. Description of the Prior Art

A difficulty encountered with the use of the popular "post" or closed-stem earrings intended for use with pierced ears is the possibility of allergic reactions and other irritations to the sensitive tissue of the lobe from the metals used to construct the earrings. Frequently, many women are unable to wear earrings or are restricted to wearing only certain styles of earrings or earrings constructed from certain metals.

U.S. Pat. No. 161,853, issued Apr. 13, 1875, to A. S. Baker, discloses an earring guard or re-enforce consisting of a pair of telescoping, flanged, hollow tubes which fit into the aperture in the earlobe. Such an arrangement, however, is necessarily bulky and in any event is intended only as a "locking" device for open-stem earrings, rather than as protection of the tissue of the earlobe from possible allergic effects of direct contact with a metal earring stem, since plastics capable of functioning in this manner were not available at that time. The sole purpose of the device of U.S. Pat. No. 161,853 appears to be to prevent an open-stem earring from climbing out of an associated earlobe.

U.S. Pat. Nos. 2,568,207, issued Sept. 18, 1951, to R. W. Spicher; 3,500,829, issued Mar. 17, 1970, to H. Abramowitz; and 3,527,223, issued Sept. 8, 1970, to M. Shein, also show tubes disposed in the aperture of a pierced earlobe. These devices, however, are surgical instruments intended to remain in the lobe only while it heals, and are not intended to be in the earlobe aperture while an earring is being worn.

SUMMARY OF THE INVENTION

It is an object of the present invention to provide protection from metal irritation for the tissue of a pierced earlobe.

It is another object of the present invention to provide protection for the tissue of pierced earlobes that can be used with existing earrings.

These and other objects are achieved by providing a liner including a hollow body forming a through passage for receiving the stem of an earring, and provided with an outer surface constructed from a hypoallergenic material for protecting the tissue of an earlobe from irritation by the metal material forming the stem of the earring. By the "stem" as used herein is meant that portion of a closed-stem earring which passes through the aperture formed in a pierced earlobe.

While one basic embodiment of the invention contemplates insertion of the liner into the aperture of the earlobe and subsequently passing the stem of an earring through the liner, another embodiment of the invention provides for fitting the liner onto the earring stem prior to insertion of the liner into the earlobe aperture. With the latter form, it will be appreciated that the liner will remain with the earring even when the earring is not being worn.

These together with other objects and advantages which will become subsequently aparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
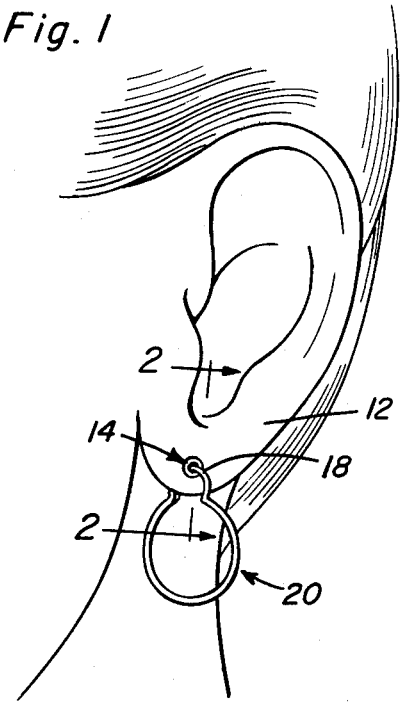
FIG. 1 is a fragmentary, schematic, perspective view showing a liner according to the present invention supporting an earring in a pierced earlobe.
Figure 2:
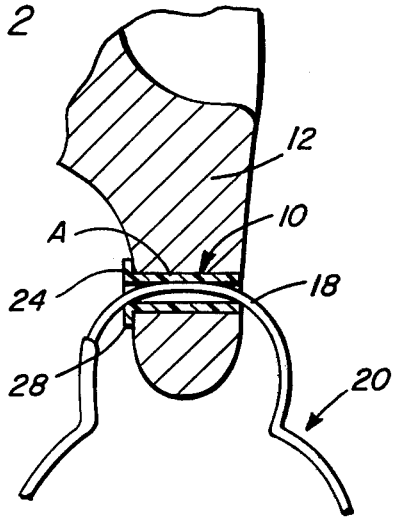
FIG. 2 is a fragmentary, enlarged, sectional view taken generally along the line 2—2 of FIG. 1.
Figure 3:
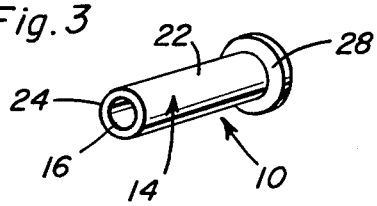
FIG. 3 is an enlarged, perspective view showing the embodiment of FIGS. 1 and 2.

Referring now more particularly to FIGS. 1 through 3 of the drawings, a liner 10 according to the invention is shown disposed in the aperture A of an earlobe 12. This liner 10 includes a hollow body 14 forming a through passage 16 arranged for receiving the metal stem 18 of a conventional closed-stem earring 20. Body 14 is provided with an outer surface 22 constructed from a hypoallergenic material for protecting the tissue of earlobe 12 from irritation by the stem 18.

Preferably, body 14 is a flexible tube constructed from a suitable, known hypoallergenic material, such as an elastic latex, either natural or synthetic.

Since body 14 is substantially cylindrical in configuration, it is bounded by a pair of substantially planar, spaced end surfaces 24 and 26 in which the passage 16 terminates. A generally circular flange 28 is provided on the body adjacent one of the end surfaces 24, 26, with the flange 28 being arranged adjacent the end surface 26 as shown in FIGS. 1 through 3, for facilitating retention of the body 14 in an earlobe 12.

Figure 4:
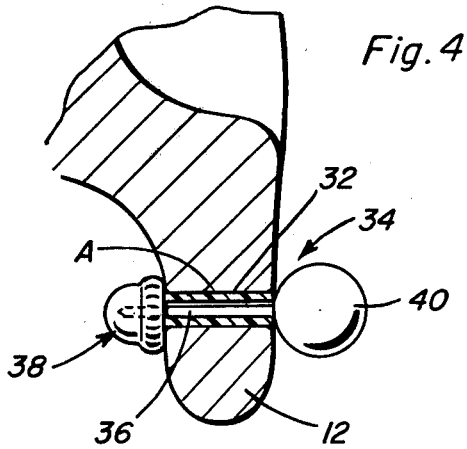
FIG. 4 is a fragmentary, sectional view, similar to FIG. 2, but showing a modified form of a liner according to the present invention supporting a straight-stem earring in an earlobe.
Figure 5:
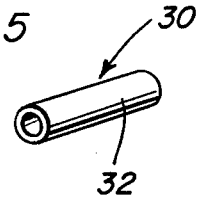
FIG. 5 is a perspective view showing the modified liner of FIG. 4.

While the provision of a flange 28 is desirable for use with many kinds of closed-stem earrings, FIGS. 4 and 5 of the drawings show a liner 30 according to the present invention which omits the flange and is formed only by a generally cylindrical hollow body 32. This liner 30 can be employed with an earring, such as that designated 34, which has a substantially straight stem 36 so as to permit the earring 34 to grip body 32 between the clamp fastener 38 and the dectorative head 40 of the earring.

Figure 6:
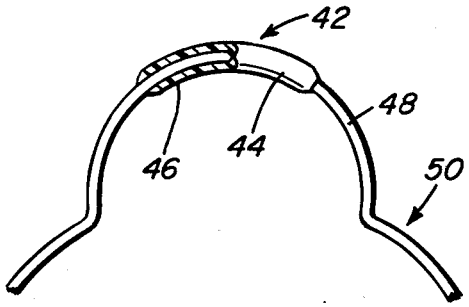
FIG. 6 is a fragmentary front elevational view, partly cut away in section, showing an embodiment of a liner according to the present invention wherein the liner is fitted onto the stem of a closed-stem earring.

Referring now to FIG. 6 of the drawings, a liner 42 according to the present invention is formed by a body 44 provided with a through passage 46 which advantageously fits tightly on stem 48 of a closed-stem earring 50. In this manner, liner 42 is retained on stem 48 at all times, even when earring 50 is not being worn. This type of liner may be placed onto the post or stem by spraying a hardenable plastic material thereon or otherwise coating a portion of the post or stem with a layer of plastic material.

It will be appreciated that liner 30 may also be designed so as to fit tightly on stem 36 of earring 34 in a manner similar to the fit between liner 42 and stem 48 of earring 50 so as to result in liner 30 being retained on stem 36 even when earring 34 is not being worn. This arrangement enables the post or stem 36 to be inserted through the liner 30 which will be frictionally held in place thereon. The assembled liner and post or stem will then be inserted into the perforation in the earlobe. Also, it is within the preview of this invention to construct the entire post or stem of plastic material such as surgical grade plastics.

As can be readily understood from the above description and from the drawing, a liner according to the present invention results in simple and inexpensive protection for the tissue of an earlobe against the possible irritation, infection and allergic reaction from the metal post or stem of an earring without requiring the earring to be modified in any manner. Thus, the invention can be employed with existing earrings and earrings may also be constructed of other metals which cannot now be used because of their known adverse affects when in direct contact with flesh.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an earring assembly having a metal stem; the improvement being a protector for previously pierced earlobes, comprising, a hollow tube of one piece unitary construction and forming a through passage for receiving the metal stem of said earring, said tube being provided with a generally cylindrical outer surface and constructed of a hypoallergenic flexible plastic material for protecting the tissue of an earlobe from irritation and allergic reaction by the metal of the earring stem, said tube fitting tightly on and being frictionally held on the earring stem for insertion of the assembled tube and earring stem and removal of the assembled tube and earring stem with respect to the pierced earlobe, the ends of the tube extending to the front and rear surfaces of the earlobe for spacing the metal stem from the earlobe and for retention therein along with the earring stem.

2. A structure as defined in claim 1, wherein the tube has spaced, planar end surfaces, the through passage terminating in the end surfaces, and further includes a circular flange provided thereon at only one of the end surfaces for facilitating retention of the tube in an aperture of a pierced earlobe while enabling the other end of the tube to pass through the pierced earlobe.

* * * * *